United States Patent [19]

Parks et al.

[11] 3,960,650

[45] June 1, 1976

[54] MACHINE AND METHOD FOR MAKING A LAMINATE STRUCTURE

[75] Inventors: Dewey P. Parks, Orange City, Fla.; Charles R. Scott, Sugar Grove, Va.

[73] Assignee: Brunswick Corporation, Skokie, Ill.

[22] Filed: Jan. 13, 1975

[21] Appl. No.: 540,494

[52] U.S. Cl. ..... 162/103; 162/108; 162/127; 162/131; 162/197; 162/258; 162/265; 162/268

[51] Int. Cl.[2] ..... D21D 3/00

[58] Field of Search ..... 162/103, 108, 268, 201, 162/258, 197, 266, 123, 127, 129, 130, 131, 265; 428/919

[56] References Cited

UNITED STATES PATENTS

| | | | |
|---|---|---|---|
| 1,854,414 | 4/1932 | Milkey | 162/268 X |
| 2,214,772 | 9/1940 | Muggleton | 162/266 X |
| 3,053,762 | 9/1962 | Adiletta | 162/108 X |
| 3,158,532 | 11/1964 | Pall et al. | 162/103 X |
| 3,161,563 | 12/1964 | Walker et al. | 162/197 |
| 3,256,138 | 6/1966 | Welch et al. | 162/127 X |
| 3,676,295 | 7/1972 | Rice | 162/258 X |

FOREIGN PATENTS OR APPLICATIONS

| | | | |
|---|---|---|---|
| 1,245,092 | 7/1963 | France | 162/108 |
| 306,422 | 6/1917 | Germany | 162/103 |
| 1,258,943 | 12/1971 | United Kingdom | |

*Primary Examiner*—S. Leon Bashore
*Assistant Examiner*—Marc L. Caroff
*Attorney, Agent, or Firm*—John G. Heimovics; David S. Guttman; John J. Connors

[57] ABSTRACT

This invention comprehends a machine for producing a composite laminate structure wherein one layer is a base material, such as a non-woven fabric, a second layer, interspersed with the first layer, is substantially a two dimensionally randomly oriented fiber layer. The fibers are bonded to the first layer by resin which is applied from underneath the first layer so as not to disturb the orientation of the fibers. Also comprehended is a method of making such a composite laminate structure.

12 Claims, 10 Drawing Figures

FEED BACK CONTROL SYSTEM
110
SLURRY
50
SUPPORT AND UNWIND
20-21
PRE-MOISTURIZER
24
SUCTION DISPOSITION
30
IMPREGNATION
42
PREHEATING
78
OVEN
80
COMPRESSION
82
INSPECT
84
RE-SPOOL
90

10
11
12
13
14

51a
$H_2O$
$H_2O$
51
NEW WATER
64a
53a
53
52a
52
54c
55c
RECIRCULATORY TANK
54
A
B
55
63
60
56b
56
54a
55a
64
54b
55b
PUMP
60a
65
57a
FEED BACK CONTROL SYSTEM
110
57
60b
MIXING CHAMBER
58
12
59
32
50
38
38
62
50
35
62a
61
10
34
61a

MACHINE AND METHOD FOR MAKING A LAMINATE STRUCTURE

BACKGROUND OF THE INVENTION

1. Field of the Invention

This invention relates to a machine and process for producing a laminate structure, and more particularly, it relates to a machine and process for coating a base material, such as a fabric, with a two dimensional layer of fibers, then bonding the fibers to the base material by the use of resin in order to make an impregnated laminate structure. This laminate may be used as is; or, by way of example, it may be further processed such as by applying a color coating to each side of the material in order to make it into a colored laminate material.

2. Background of the Invention

The manufacturing and processing of laminate materials is well taught in the prior art with thousands of patents and hundreds of books being published on the subject. In fact, in certain specific fields, such as the manufacture of camouflage materials, a laminate structure comprising a base material such as a fabric that has a network of short length, small diameter metal fibers is taught in British Pat. No. 1,258,943. Other such structures wherein other fiber materials are deposited in a two dimensional array on foraminous base materials is also well known in the art. However, nowhere does the art teach an economical and efficient machine or method for making such laminate material with a preselected amount of fibers bonded to the base material. Quite surprisingly, accomplishing this task proved to be quite difficult.

SUMMARY OF THE INVENTION

This invention relates to a machine and method for making a laminate structure with a base foraminous material, such as a porous paper, having a preselected randomly disposed two dimensional fiber layer thereon with the fiber being bonded, such as by a resin, to the base material. The resin may also be used to impregnate part or all of the base material, as desired. The machine used in making this product includes means for unrolling and feeding the base material to a fourdrinier head box wherein a slurry of liquor and fiber is deposited on the foraminous material with the liquor being suction removed. The fibers are bonded to the base material and the bonding agent may be cured. The laminate may be compressed or calendarized prior to inspecting and rewinding. The product made from this machine can be used as a laminate structure or may be further processed, such as by applying to both sides of the material color coats making a material suitable for camouflage garnish. For use of such material as a camouflage garnish see our co-pending application Ser. No. 540,495, filed Jan. 13, 1975 entitled "MACHINE AND METHOD FOR MAKING CAMOUFLAGE NETS."

It is therefore an object of this invention to provide a machine for making a laminate structure comprising a base material with a second layer comprising a two dimensional array of fibers thereon.

It is another object of this invention to provide such a machine wherein the fiber layer is bonded by a cured resin to the base material.

Yet another object of this invention is to provide a machine wherein inspection of the product occurs as the product is being made and in the event of fluctuations in the product the inspection device can automatically or semi-automatically correct the process by a means of feedback system.

Still another object of the invention is to provide a method of making a laminate structure starting with a base material layer, applying a second layer of a two dimensional array of fibers in a preselected amount to the first layer and then bonding the fibers to the material.

And yet another object of this invention is to provide for each a method wherein the fiber layer constitutes from about 0.5% to about 100% by weight of the base material.

The feature of this invention is that the product made by the method and machine described herein can be further processed to be used as a camouflage garnish or numerous other materials such as anti-static fabrics such as uniforms and floor and wall coverings.

Another feature of this invention is that the fiber layer is made of metal fibers having a diameter of approximately 4 to 50 microns.

Yet another feature of this invention is that the bonding agent for securing the fiber layer to the base material layer is a resin which may comprise, after curing, part of the laminate structure.

The above and other and further objects and the features will be more readily understood by reference to the following detailed description and accompanying drawings.

DESCRIPTION OF THE PREFERRED EMBODIMENTS

Figures 1, 6, 7, 8:
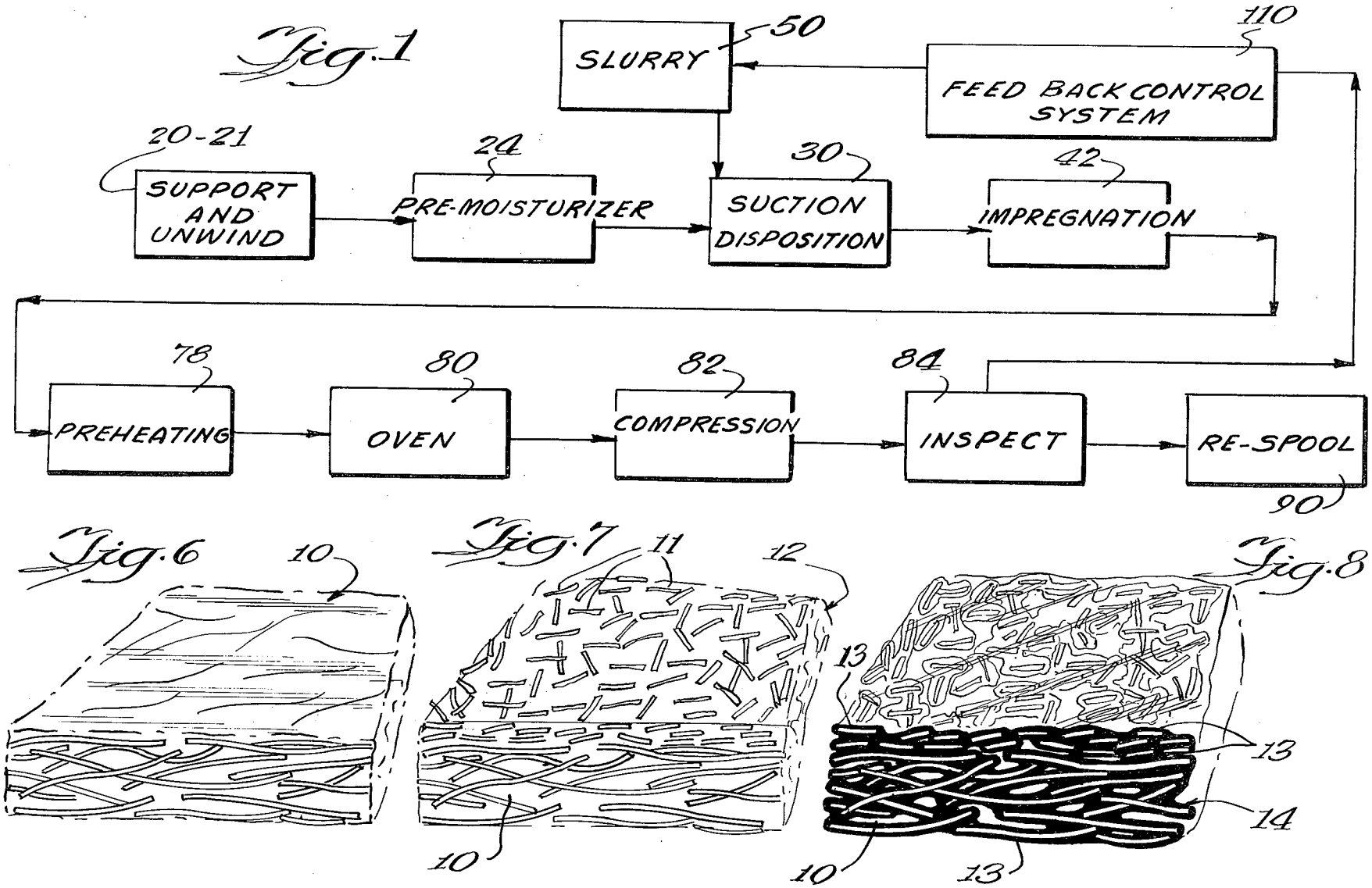
FIG. 1 is a block schematic view of the process performed by the machine of this invention.
FIG. 6 is a segmented perspective view of the base material.
FIG. 7 is a segmented perspective view of the base material with a two dimensional array of fibers thereon; and, FIG. 8 is a segmented perspective view of the resin impregnated laminate.
Figure 2:
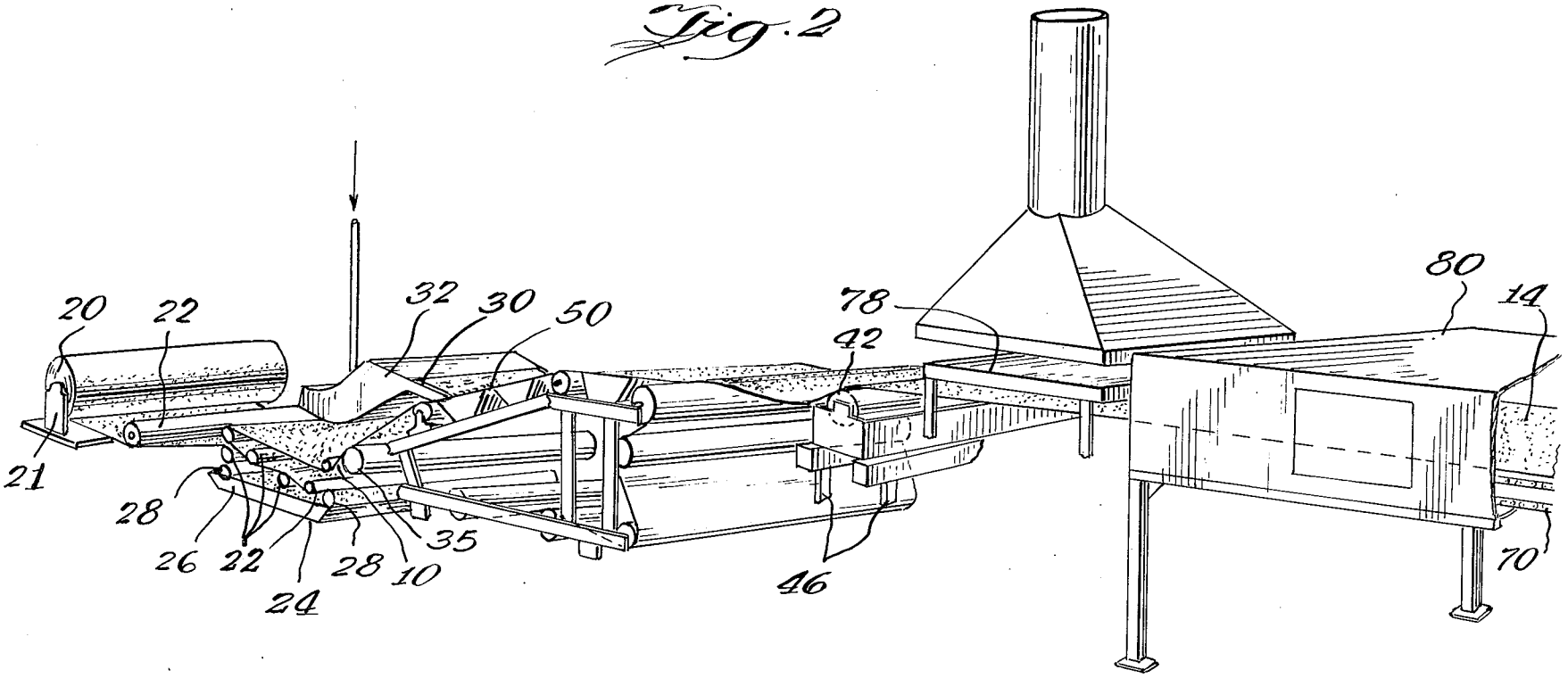
FIG. 2 is a perspective view of the first part of the machine.

This invention comprehends as a preferred embodiment a machine and a process for making a laminate material (referring to FIGS. 6, 7 and 8) starting with a foraminous base material 10, for example a porous paper, a woven or knit fabric, a substantially two dimensional non-woven fabric or felt, a a spun bonded synthetic fiber product which includes non-woven products such as CEREX (a trademark product of the Monsanto Corporation) or REMAY (a trademark product of the Dupont Corporation) with a substantially two dimensional layer of randomly oriented fibers 11 deposited on the surface of the material 10 to form a laminate 12. The laminate 12 is then impregnated with a resin 13 to bond the fibers 11 to the base material 10 thus forming a resin impregnated fiber laminate material 14. If desired, the material 14 may then be formed into a compressed laminate material 16 by compression, compaction, calendering, crimping, etc., as desired. The fibers 11 can be organic, natural or metallic filaments and can be of any preselected size of diameter or length. The weight of fibers 11 can be approximately 0.5 to about 100% of the base material. Obviously, since cotton weighs one-seventh as much as stainless steel the weight percentage for stainless steel can be much greater than cotton, yet much fewer fibers might be used. When metal fibers having a diameter of from about 4 microns to about 50 microns are used, they can constitute from about 3 to 20 % by weight of the base material. Preferably when a base material weighting 1.5 oz. per sq. yard is used the metal fibers will be present in about 2% to 8% by weight and most preferably about 3% by weight. In this preferred embodiment the resin content will be from about 10% to 100% by weight of the base material. Preferably when a 1.5 oz. per. sq. yard base material is used, the resin content is most preferably about 33% by weight of the base material. The resin can be selected from (1) water disperesed resins including polyvinyl chloride, nitril rubbers, neoprene, polyvinylidene but not limited thereto; (2) water soluble resins including polyvinyl alcohol, polyvinyl pyrollidone, methyl cellulose; or (3) numerous non-water soluable or dispersible resins. Special care must be taken in using textile metal fibers to insure that the ends of the fibers are not hooked. One technique for providing such metal fibers as taught in copending U.S. patent application Ser. No. 533,988, filed Dec. 18, 1974, entitled PROCESS FOR PRODUCTION OF PRECISION CUT LENGTHS OF METAL FIBERS, and owned by the assignee hereof. It has been found extremely economical and efficient to produce the laminate material 14 or 16 by the method and machine described herein.

The operation of the machine and the process is best understood by reference to FIGS. 1, 2, 2A, 3 and 3A. In one preferred embodiment of the invention a 2,000 to 4,000 yard roll of CEREX non-woven material 10, about 60 inches wide, is placed on spool 20 that is journally mounted on stand support 21. The material 10 passes underneath journaled guide roll 22 to the pre-moisturizer 24 wherein additional journal mounted guide rolls 22 guide material 10 to the pre-moisturizer rollers 28 which submerge the material 10 in the pre-moisturizer pan 26. When the fourdrinier slurry liquor is water and resin is water dispersible material the pan 26 is filled with water. Obviously other solutions and solvents may be used as desired. The material 10 then passes to the slurry deposition section 30 where the fibers 11 are deposited onto the base material 10. The slurry deposition section 30 comprises a fourdrinier head box 32, a fourdrinier screen 34 that continuously and endlessly passes beneath the head box 32 carrying the material 10. The screen 34 is supported by lead-in roller 35 and support rollers 36. The material 10 enters the slurry deposit section 30 inbetween the screen 34 and the head box 32 near the roller 36. As the material 10 passes beneath the fourdrinier head box lip 33, the slurry 50 with the fibers 11 is deposited on the moving material 10 supported by screen 34 in a quasi-flotational manner. Suction boxes 38 rapidly withdraw the water or slurry liquor through the foraminous material 10 and the screen 34 leaving the fibers 11 deposited in a two dimensional array. The now laminate material 12 passes over the resin impregnation roll 42 which is mounted above resin reservoir 44, both being supported by frame 46.

Figure 5:
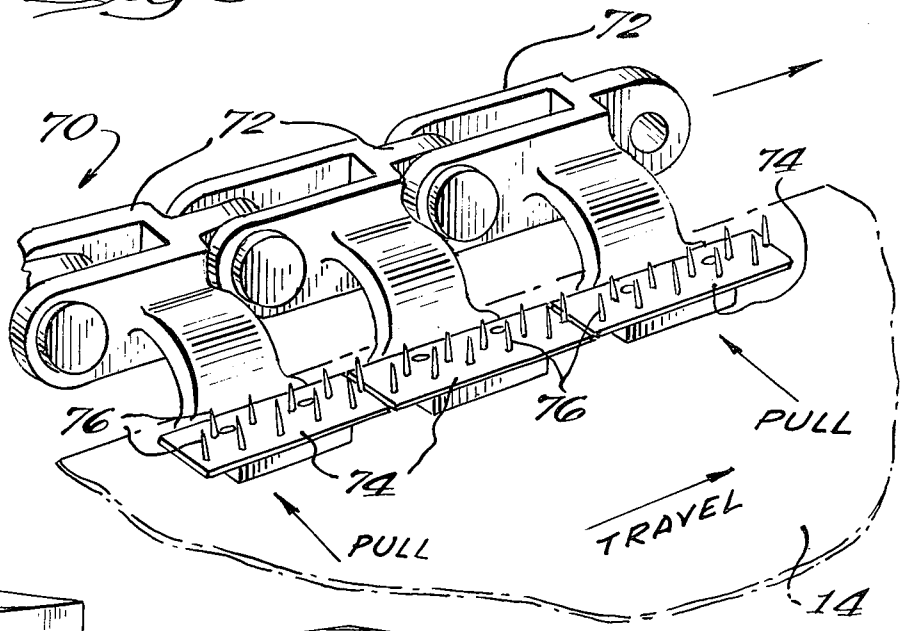
FIG. 5 is a perspective view of the tension conveyor link.
Figure 2A:
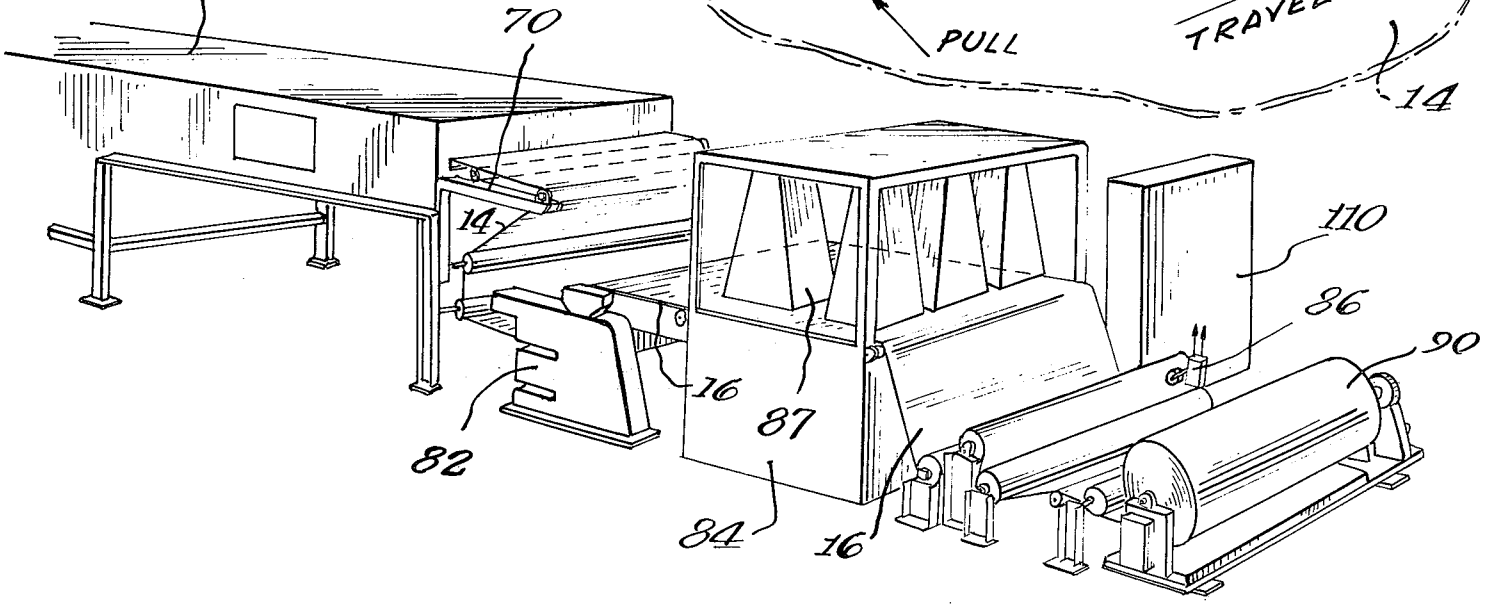
FIG. 2A is the perspective view of the second part of the machine.
Figure 3:
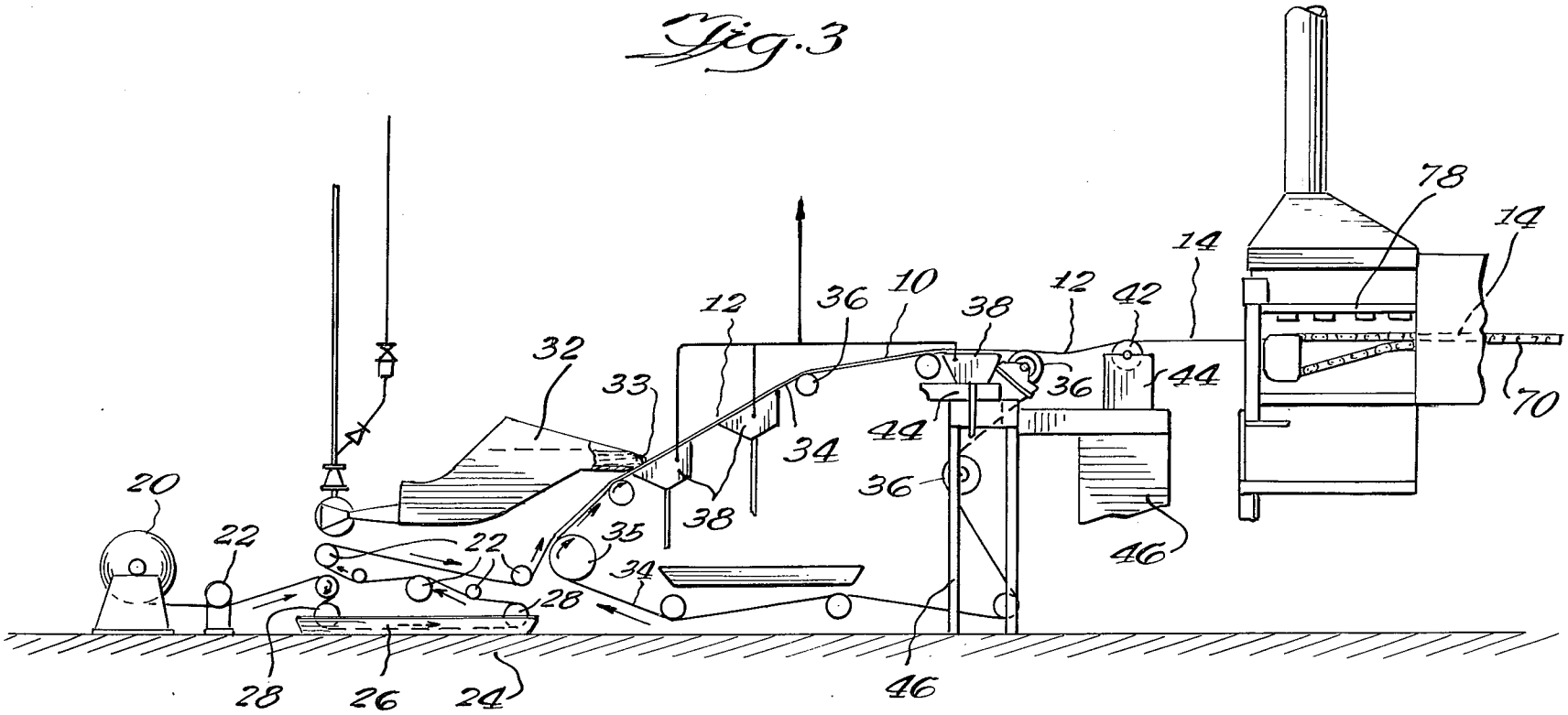
FIG. 3 is a semi-schematic side view of the first part of the machine.
Figure 3A:
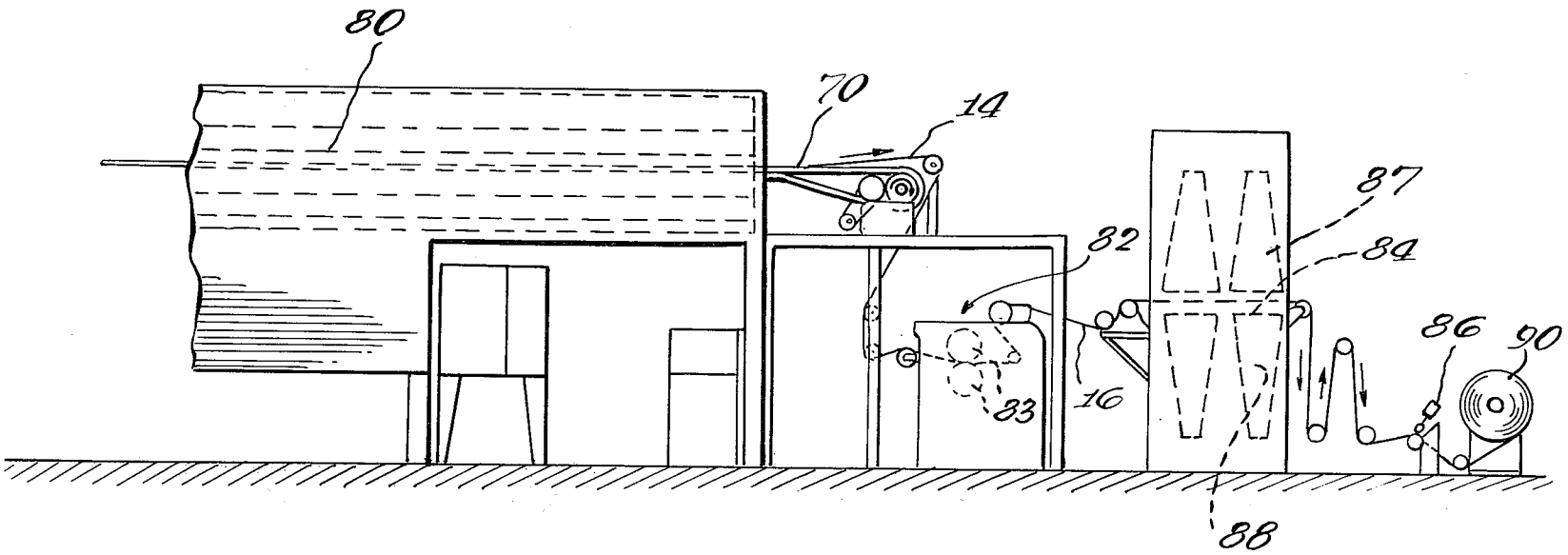
FIG. 3A is a semi-schematic side view of the second part of the machine.

As the laminate material 12 passes over the impregnation roller 42 with resin 13 coating the base material 10 and fibers 11 it is introduced to conveyor 70. Conveyor 70 has special conveyor chains having side chain links 72 with upright needles 76 mounted on needle plate 74 that grip and stretch the material 14 as it proceeds along the conveyor 70. These special links 72 are depicted in FIG. 5 with a section of material 14 shown in the phantom.

Material 14 enters the radiant preheater 78, and in one preferred embodiment the preheater 78 is 4.2 feet long and maintained at a surface temperature of about 1500°F. In this embodiment material 14 is traveling at a speed of approximately 80 feet per minute. When the resin is water soluble or dispersible, then the sides of the preheater can be left opened to the atmosphere and approximately 20% of the water moisture can be removed from the material 14. For resins soluble or dispersible in liquids others than water, normally the preheater will be closed to the atmosphere and a hood will be provided over the preheater 78 so that fumes may be properly removed. Preferably the speed of the material 10 can vary anywhere from 40 to 200 feet a minute depending, in part, upon the type of fiber slurry deposition, the amount of fiber, the type of fiber, the resin coating, and the type of base material. Obviously other variables can affect the speed with which the material 10 travels through the machine.

Even though the material 4 is being pulled partially through the machine by conveyor links 72 of chain 70 in cooperation with the needles 76, the links 72 and the needles 76 also pull the material at approximately 90° to its main direction of travel so that the material is kept very tight and will dry evenly as it continues through preheater 78 and the oven 80. After the material 14 leaves the oven 80 it is removed from conveyor 70 by a stripper finger (not shown) and enters the compression section 82 where a series of heated rolls 83 compress the material to the desired thickness and it becomes a compressed resin impregnated fiber laminate material 16. Alternatively, the material may be calendered, crimped, or corrugated in station 82, as desired. The material then proceeds to the inspection station 84 where it is inspected for such items as the proper fiber density, orientation of fibers, and thickness. The material 16 is then respooled in station 90 so that it may be removed from the machine and further processed, as desired.

Not only can the inspection station 84 inspect the material 16, but it can indicate on the material 16 the portions that do not meet the pre-established standards. The inspection station 84 can cause the fault marker 86 to place an identifiable mark on the substandard portions of the material 16 so that it can be removed from the roll at a later date. If desired, the inspection station 84 can also monitor the density of the fiber deposition from slurry 50 on the material 10 and trigger a light or signal on an indicator board (not shown) that adjustments should be made. Alternatively, inspection station 84 can be connected through the feedback control system 110 with a computer (not shown) directly to the slurry deposition section 30 to control the amount of either new water or concentrate water that comprises the slurry (hereinafter discussed).

In one preferred embodiment of the invention where metal fibers having a diameter of approximately 8 microns and a length of approximately 0.170 inch have been deposited on a non-woven textile material 10 and resin bonded thereto by a copolymer resin of PVC present in about 33% by weight, the fibers comprise about 3% by weight of the base material. The inspection station 84 utilizes three different heads 87 transmitting at 9.375 GHz modulated, respectively, by frequencies of 510 Hz, 1300 Hz, and 2300 Hz in order to check the radar transmission, reflection and polarization of the material 16. These frequencies are generated with a known amount of energy and the sensors 88 measure the amount of energy absorbed and reflected and compare it with a baseline standard in a computer (not shown). If the material 16 is not within tolerance then that portion is immediately marked by the fault marker 86 so that it can be removed later. Obviously, other types of inspections can be made with respect to other physical characteristics of the material as desired.

Figure 4:
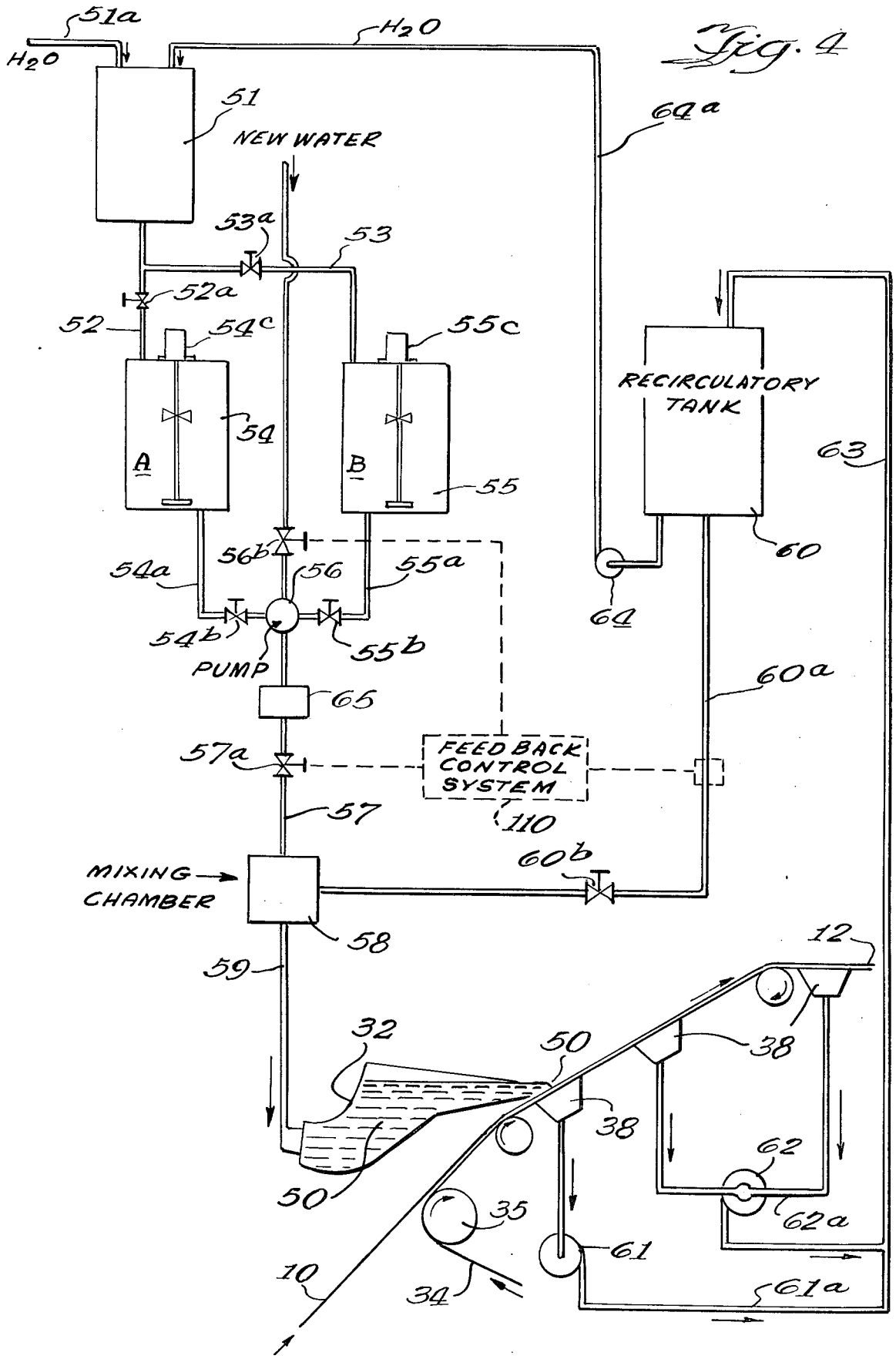
FIG. 4 is a schematic view of the piping and tank arrangement.

Referring now to FIG. 4 and a preferred embodiment of the invention where the slurry liquor is water, city water is used to fill up the 10,000 gallon water storage tank 51 by means of pipe 51*a*. The water from tank 51 is used to fill a 6,000 gallon concentrate tank 54 by closing valve 53*a* and opening valve 52*a* letting the water flow through pipe 52. When the tank 54 is filled to the desired level, valve 52*a* is closed and valve 53*a* is opened so that tank 55 may be filled to the desired level through pipe 53. In one preferred embodiment of the invention, 8 micron stainless steel fibers each having a length of 0.170 inches are added to the tank 54 in the ratio of 0.55 grams of fibers per gallon of water. The mixer or beater 54 is turned on to form a uniformly mixed slurry 50 of meatl fibers and water. By closing valve 55*b* and opening valve 54*b* the slurry liquor can be pumped by constant flow pump 56 through pipe 57 to the mixing chamber 58. New or city water is added at the pump 56 diluting the concentrate slurry from tank 54 to 55. The fiber density monitor 56 senses the amount of fiber in the slurry in pipe 57 and automatically adjusts the valve 56*b* controlling the amount of new water in order to change, when necessary, the fiber concentration level of the slurry. A special controllable metering valve 57*a* is provided between the pump 56 and the mixing chamber 58 in order to control the rate of flow to the chamber 58. The valve 57*a* may be operated either automatically or manually, as desired. Water from recirculating tank 60 is added to the mixing chamber 58 by opening controllable metering valve 60*b* (operated either automatically or manually, as desired) so that recirculating water may flow through pipe 60*a* into the mixing chamber 58. In the mixing chamber 58 a proper amount of recirculating water is added to a preselected amount of concentrated slurry from tank 54 or 55 to dilute the slurry to the desired consistency prior to its passing through pipe 59 into the head box 32.

As the concentrated slurry is being used from tank 54, tank 55 with a second batch of concentrated slurry is prepared so that when tank 54 is empty valve 54*b* is closed and valve 55*b* opened and the slurry from tank 55 is used. Thus it is possible to oscillate back and forth between tank 54 and tank 55 so that a constant source of concentrated slurry is always available. After the slurry 50 is deposited on the material 10 the liquor or water portion of the slurry is removed from the material 10 by means of vacuum suction pumps 61 and 62 that are attached to the suction boxes 38. The water withdrawn by pumps 61 and 62 is combined and charged back into the recirculating tank 60 by means of pipes 61*a* and 62*a* feeding into pipe 63. In the event that there is an excess of recirculating water at any one time in the system, it can be discharged by pump 64 through pipe 64*a* into water storage tank 51.

As previously discussed it is possible to couple the control portion of the inspection station 84 to the valves 56*a*, 57*a* and 60*b* to form part of a feedback system so that the flow of the recirculating water, the new water and the concentrate slurry may be varied with respect to each other by means of valves 56*a*, 57*a* and 60*b* thereby altering the amount of fiber 11 that is deposited on the material 10. Also by use of a computer (not shown) that is coupled to inspection station 84 and the screen 34 drive motor (not shown) a second feedback control system may be formed to alter and adjust the speed of the respooling station 90. Thus it is possible to vary the amount of fiber deposition on the material 10 by two different feedback systems by employing the monitoring portion of inspection station 84 and a computer coupled with the screen 34 drive motor or the slurry valving.

By use of the machine and method described herein above, one is able to economically, efficiently and automatically produce a compressed resin impregnated fiber laminated material. By varying the amount of resin, the fiber layer and starting base material any reasonable degree of porosity (or no porosity) may be obtained in the final material. Although specific embodiments of the invention have been described, many modifications and changes may be made in the machine or the process without departing from the spirit and scope of the invention as defined by the appended claims.

We claim:

1. A method of making a laminated sheet comprising the steps of:

a. providing a roll of foraminous material mounted on a spool;
b. unwinding the material from the spool in a first direction;
c. pre-moisturizing the material with a liquid solution;
d. backing the pre-moistened material with a fourdrinier screen;
e. feeding the pre-moistened material to a fourdrinier head box;
f. depositing at a preselected controlled rate a slurry of liquid and fibers onto the material;
g. withdrawing by suction the liquid through the material and the screen leaving a substantially two dimensional randomly dispersed array of fibers on the upper side of the material;
h. impregnating, from underneath, the material and the fibers on the upper side of the material with a liquid dispersible resin thereby not disturbing the orientation of the dispersed fiber;
i. continuously stretching the material at approximately 90° to its first direction of travel;
j. preheating the fiber coated resin impregnated laminate material to a temperature sufficient to remove part of the liquid;
k. heating the laminate material to a sufficient temperature to remove the remaining liquid and cure the resin;

l. compressing the laminate to a desired thickness with heat rollers;

m. inspecting the cured laminate with a feedback arrangement to control the rate of fiber deposition; and, n. respooling the laminate.

2. The method of claim 1 wherein the resin is dispersible in the same liquid used in the slurry.

3. The method of claim 1 wherein the fibers are metal fibers.

4. The method of claim 1 wherein there is some porosity in the resin impregnated laminate material.

5. An apparatus for making a laminate sheet comprising:

a. means for feeding a foraminous material to a fourdrinier head box;

b. means for depositing fibers from a liquid on one surface of the material in a random two dimensional array;

c. means for removing the liquid and leaving the fibers in a random two dimensional array on the material; and, d. means for permanently securing the array of fibers to the material from underneath the material so as to not disturb the orientation of the fibers.

6. The apparatus of claim 5 wherein the fibers are metal.

7. The apparatus of claim 6 wherein metal fibers are stainless steel.

8. The apparatus of claim 5 further including means to pre-moisturize the foraminous material prior to depositing fibers thereon.

9. The apparatus of claim 5 further including, as part of the means for securing the fibers on the material, means for applying resin from the underside of the material.

10. The apparatus of claim 5 further including means for spooling the laminate sheet.

11. The apparatus of claim 10 further including means for inspecting the material prior to spooling.

12. The apparatus of claim 5 further including means for stretching the material at about 90° to its direction of travel while the liquid is being removed.

* * * * *